United States Patent [19]

Nonnenmacher et al.

[11] 3,969,038

[45] July 13, 1976

[54] PRESSURE REGULATOR FOR AN ADJUSTABLE PUMP

[75] Inventors: Gerhard Nonnenmacher, Korntal; Paul Bosch, Ludwigsburg; Hans-Jürgen Fricke, Stuttgart, all of Germany

[73] Assignee: Robert Bosch G.m.b.H., Stuttgart, Germany

[22] Filed: Nov. 8, 1974

[21] Appl. No.: 522,216

[30] Foreign Application Priority Data

Nov. 20, 1973 Germany ..... 2357801

[52] U.S. Cl. ..... 417/218

[51] Int. Cl.[2] ..... F04B 49/00

[58] Field of Search ..... 417/212, 213, 218–222

[56] References Cited

UNITED STATES PATENTS

| | | | |
|---|---|---|---|
| 2,662,543 | 10/1953 | Stacey | 137/102 |
| 3,067,693 | 12/1962 | Lambeck | 417/219 |
| 3,669,570 | 6/1972 | Himmler | 417/218 |
| 3,809,500 | 5/1974 | Staudenrausch | 417/222 |

*Primary Examiner*—William L. Freeh
*Assistant Examiner*—G. P. LaPointe
*Attorney, Agent, or Firm*—Michael J. Striker

[57] ABSTRACT

A pressure regulator for an adjustable pump has an adjustable member for regulating the amount of fluid delivered by the pump. The position of the adjustable member is adjusted by two pistons of different diameters acting from opposite sides of the adjustable member and in which pressure of the fluid delivered by the pump is directed through a passage controlled by a control valve to one of the cylinder bores in which one of the pistons is closely guided. The control valve is movable by the fluid pressure between a neutral position in which fluid from the pump is prevented from flowing into the cylinder bore of the one piston, and two working positions, in one of which fluid from the pump will flow to the cylinder bore of the one piston while part of the fluid will flow over a throttle to a space at atmospheric pressure, and in the other of which fluid will flow unthrottled from the cylinder bore of the one piston to the aforementioned space.

6 Claims, 3 Drawing Figures

Fig.1
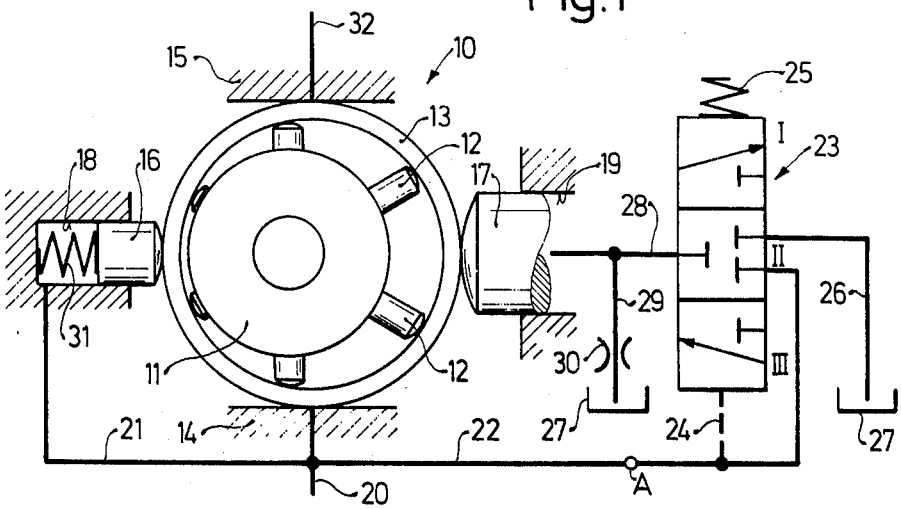
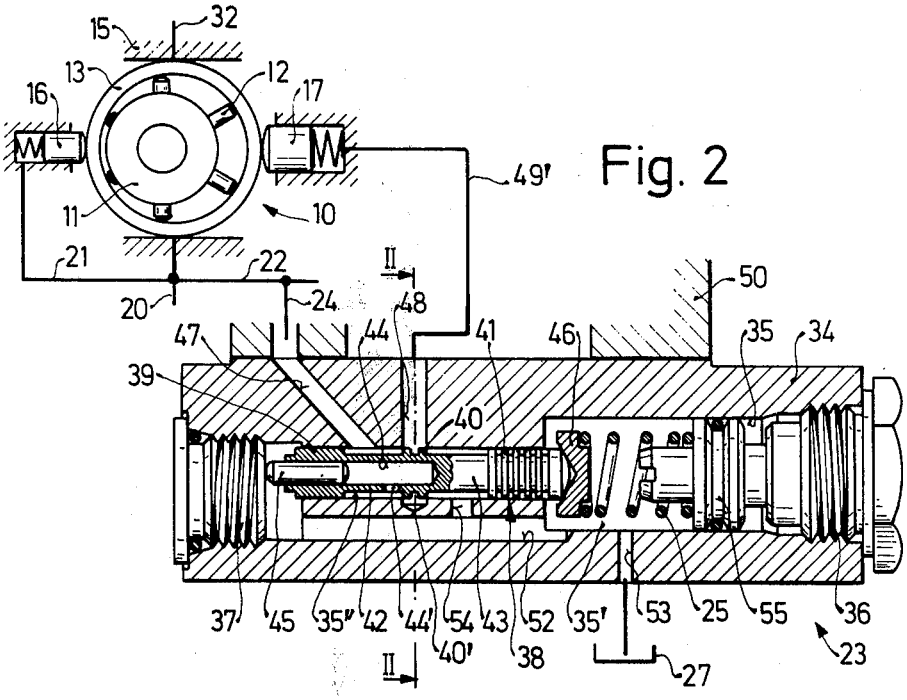
Fig. 2
Fig.3
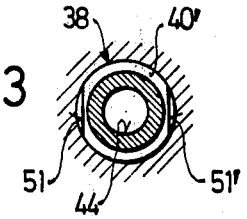

PRESSURE REGULATOR FOR AN ADJUSTABLE PUMP

BACKGROUND OF THE INVENTION

The present invention relates to a pressure regulator for an adjustable pump having an adjustable member for regulating the amount of fluid delivered by the pump. The position of the adjustable member can be adjusted by two pistons of different diameters acting from opposite sides on the adjustable member and in which pressure of the fluid delivered by the pump is directed through a passage controlled by a control valve to one of the cylinder bores in which one of the pistons is closely guided.

A throttle is often arranged in the channel leading from the outlet of the pump to one of the pistons acting on the adjustable member through which fluid from the pump will flow to the aforementioned piston when the minimum pressure of response of the pressure regulator is lower than the pressure of the fluid delivered by the pump. The aforementioned throttle serves thereby to stabilize the adjustable member in a predetermined range of adjustment. A disadvantage of the aforementioned pressure regulators is that the mentioned arrangement of the throttle cannot always be constructively realized. In addition, it is not possible without further means to adjust the pump to an adjustable minimum stroke, as often desired, since this requires an adjustable abutment on one side of the regulator.

SUMMARY OF THE INVENTION

It is an object of the present invention to provide a pressure regulator of the aforementioned kind which avoids the disadvantages of such pressure regulators known in the art.

It is a further object of the present invention to provide a pressure regulator of the aforementioned kind which is simple in its construction and which can be realized in an advantageous manner regardless of the constructive characteristics of the pump.

With these and other objects in view, which will become apparent as the description proceeds, the pressure regulator according to the present invention for an adjustable pump having an outlet at which fluid under pressure is delivered by the pump, mainly comprises an adjustable member for regulating the amount of fluid delivered by the pump, a pair of pistons respectively axially movable in cylinder bores and arranged to act from opposite sides on the aforementioned adjustable member for adjusting the position of the latter and thus the amount of the fluid delivered by the pump. First passage means connected the outlet of the pump to the cylinder bore of one of the aforementioned pistons and a control valve is arranged in the first passage for controlling the passage of fluid therethrough. A second passage communicates at one end with the mentioned first passage between the control valve and the cylinder bore of the one piston and at the other end with a space at atmospheric pressure, and a throttle is arranged in this second passage.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a schematic illustration of a pressure regulator according to the present invention for a pump;

FIG. 2 is a longitudinal cross-section through a pressure regulator according to FIG. 1 with the pump regulated thereby schematically illustrated; and FIG. 3 is a cross-section taken along the line II—II of FIG. 1 and drawn at a slightly enlarged scale.

DESCRIPTION OF THE PREFERRED EMBODIMENT

FIG. 1 schematically illustrates an adjustable pump 10 of known construction, having a rotor or cylinder block 11 provided with a plurality of substantially radially arranged bores or cutouts, not shown in the drawing, in which a corresponding plurality of pumping pistons or wings are arranged for movement in radial direction, the outer ends of which slidingly abut against the inner surface of an adjusting member, here shown as an annular member 13. The cylinder block or rotor 11 is rotated by a prime mover, not shown in the drawing, about a fixed shaft or pintle 11'. The adjusting member 13 is movable substantially normal to the axis of the shaft or pintle 11', for adjusting the amount and pressure of the fluid delivered by the pump, in two guides 14 and 15 provided in the schematically illustrated housing of the pump. The adjustment of the position of the regulating member 13 is carried out by means of two pistons 16 and 17 of different diameters which are closely guided for sliding movement in axial direction in corresponding cylinder bores 18 and 19 of the regulator housing. A passage 20 leads from the outlet end of the pump to a nonillustrated consumer. A passage 21 communicates at one end with the aforementioned passage 20 and at the other end with the cylinder bore 18 of smaller diameter, and a passage 22 leads from the passage 20 to a control valve 23 which is constructed as a three-position, three-way valve. A control passage 24 leads from the passage 22 to one end of the aforementioned control valve 23 whereas a control spring 25 acts on the other end of the valve 23.

A passage 28 leads from the control valve 23 to the cylinder bore 19 of the piston 17 and a passage 26 to a space 27 maintained under atmospheric pressure. A passage 27 branches off from the passage 28 between the valve 23 and the cylinder bore 19 to a space 27 maintained under atmospheric pressure and a throttle 30 is arranged in the passage 29. The schematically illustrated control valve 23 is movable, by the pressure of the fluid passing through conduit 24 and acting against the pressure of the spring 25, between three positions I, II and III. In the position I the passage 28 is connected with the passage 26, in the position II communication between the passages 22, 28 and 26 are interrupted, whereas in the position III the passage 22 is connected with the passage 28. A spring 31 arranged between the rear end of the piston 16 and the closed end of the cylinder bore 18 presses the pistion 16 continuously against the annular adjusting member 13 and moves the latter, when no fluid is pumped by the pump, against the piston 17 so that the annular adjusting member is then adjusted to its greatest eccentricity with respect to the axis of the pintle 11'. A suction conduit 32 is connected in a known manner, not shown in the drawing, to the pump 10 to supply the latter with fluid to be pumped.

Whereas FIG. 1 illustrates the pressure regulator and the control valve therefor in a schematic manner, FIG. 2 illustrates a practical embodiment of the pressure regulator and the control valve therefor in longitudinal cross-section. Parts shown in FIG. 2 identical with corresponding parts shown in FIG. 1 are designated in FIG. 2 with the same reference numerals.

As shown in FIG. 2, the control valve 23 of the pressure regulator comprises a housing 34 formed with a stepped bore 35 having an enlarged diameter portion 35' and a small diameter portion 35''. The opposite ends of the bore 35 are closed by screw plugs 36 and 37, respectively. A valve member 38 is closely guided in the small diameter portion 35'' of the stepped bore 35 for movement in axial direction. The valve member 38 is provided at its outer surface with three axially spaced annular lands 39, 40 and 41 between which sections 42 and 43 of smaller outer diameter are arranged. The valve member 38 is provided with an axial blind bore 44 extending from one end of the valve member into the latter. A small piston 45 is closely guided in the bore 44 and abutting with one end projecting beyond the one end of the valve member 38 against the screw plug 37 which forms part of the housing. A control spring 25 acts onto the opposite end of the valve member 38 and this control spring 25 abuts with one end thereof against the screw plug 36 and at the other against a spring retainer 46 which in turn abuts against the other end of the valve member. A transverse bore 44' in the valve member 38 provides communication between the blind bore 44 in the valve member and the bore portions 35'' in which the aforementioned valve member is axially movable.

An inclined passage or bore 47 provides communication between the passage 24, connected to the passage 22, and the bore portion 35'' of the stepped bore 35 in the housing. The passage 47 communicates with the bore portion 35'' in the region of the portion 42 of reduced diameter of the valve member 38, when the latter is in middle position as illustrated in FIG. 2. In this position, the annular land 40 of the valve member 38 overlaps a bore 48 which communicates at one end with the bore portion 35'' and at the other end with a passage 49' leading to the cylinder of the piston 17. The diameter of the bore 48 is at most as big as the width of the annular land 40 and preferably slightly smaller than this width. An annular groove 40' is provided in the annular land 40 of the valve member 38 substantially midway between opposite ends of the annular land 40 and in the portion of the annular land located to the right side, as viewed in FIG. 2, of the groove 40' there are provided two flats 51 and 51' (see also FIG. 3) which form throttle means for fluid flowing from the bore 48 to a space 27 at atmospheric pressure.

The housing 34 is further provided with a bore 52 arranged substantially parallel to the stepped bore 35 and the bore 52 communicates with the large diameter portion 35' of the stepped bore 35. A transverse bore 53 through the housing 34 provides communication between the bore portion 35' and the space 27. A further transverse bore 54 provides communication between the bore 52 and the bore portion 35'' between the annular lands 40 and 41. The diameter of the piston 17 is preferably about twice the diameter of the piston 16. The force at which the control spring 25 acts on the valve member can be adjusted by an adjustable screw part 55 threadingly connected to the screw plug 36. A passage 49' leads from the aforementioned cutout 49 into the cylinder bore 19 for the piston 17.

The arrangement described in connections with FIGS. 2 and 3 will operate as follows:

When the pump does not yet deliver any fluid to its outlet end, the spring 31 in the cylinder bore 18 will move the annular adjusting member 13 by means of the piston 16 toward the right, as viewed in FIGS. 1 and 2. The annular adjusting member 13 is thereby moved to its position of greatest eccentricity with regard to the axis of the shaft or pintle 11'. As soon as the pump starts pumping fluid, fluid pressure will be built up in the passage 20 and such fluid pressure will be transmitted, on the one hand, through the passage 21 to the cylinder bore 18 of the piston 16, and on the other hand, through the passages 22 and 24 to the bore 47 and through the transverse bore 44' into the blind bore 44 formed in the valve member 38. Such fluid pressure will act, on the one hand, onto the closed or right end of the blind bore 44 and, on the other hand, onto the inner end of the small piston 45. Since the outer or left end of the small piston abuts against the screw plug 37, the valve member 38 will now be moved against the force of the control spring 25 towards the right, as viewed in FIG. 2. Such movement of the valve member 38 towards the right and corresponding movement of the annular land 40 will establish a fluid passage from the bore 47 through the portion 42 of reduced diameter of the valve member 38 to the bore 48. Fluid under pressure from the outlet end of the pump will now pass from the passage 49' to the cylinder bore 19 in which the piston 17 is slidably arranged. Since the cross-section of the piston 17 is considerably greater than that of the piston 16, the annular adjusting member 13 will now be moved to towards the left, as viewed in FIG. 2, against the force exerted by the piston 16 on the annular adjusting member 13 since substantially the same fluid pressure will prevail in the cylinder bores 18 and 19. Part of the fluid passing into the bore portion 35'' will, when the valve member 38 is moved towards the right, in the manner as mentioned above, flow through the throttle formed by the flats 51 and 51' to the space 27 maintained under atmospheric pressure. The throttled connection between the cylinder bore 19 and the space 27 will be interrupted only when the control valve member 38 is moved so far to the right that the left edge of the annular land 40 is located at the right of the bore 48. When the pressure in the line 20 drops, then the control spring 25 will move the valve member 38 towards the left, as viewed in FIG. 2, so that the right edge of the annular land 40 will be located at the left side of the transverse bore 48 to establish a connection between the bore 48 over the valve member portion 43 to the bore 54 and therewith to the space 27. In this position of the valve member 38, pressure fluid can flow unthrottled from the cylinder bore 19 to the space 27 maintained at atmospheric pressure, the pressure in the bore 19 will therefore drop, so that the annular adjusting member 13 will be moved through the force produced by the piston 16, the cylinder bore 18 of which is continuously supplied with pressure fluid, towards the right, as viewed in FIGS. 1 and 2, to its position of its greatest eccentricity. The slots formed by the flats 51 and 51' on the annular land 40 form a fixed throttle between the valve annular part 42 acted upon the pressure of the fluid delivered by the pump and the space 27 at atmospheric pressure. The left edge of the annular land 40 forms together with the bore 48 a movable or adjustable throttle according to the prevailing pressure of the fluid delivered by the pump. This is also clearly shown in FIG. 1 of the drawing.

It will be understood that each of the elements described above, or two or more together, may also find a useful application in other types of pressure regulators for adjustable pumps differing from the types described above.

While the invention has been illustrated and described as embodied in a pressure regulator for an adjustable pump including a control valve movable by the pressure delivered by the pump between a neutral position and two working positions, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art fairly constitute essential characteristics of the generic or specific aspects of this invention.

What is claimed as new and desired to be protected by Letters Patent is set forth in the appended claims:

1. A pressure regulator for an adjustable pump having an outlet through which fluid under pressure is delivered by the pump, the pressure regulator comprising an adjustable member for regulating the amount of fluid delivered by said pump; a pair of pistons respectively axially movable in cylinder bores and arranged to act from opposite sides on said adjustable member for adjusting the position of the latter and thus the amount of fluid delivered by the pump, one of said pistons having a larger diameter than the other of said pistons; first passage means connecting the outlet of the pump to the cylinder bore of said one piston; a control valve in said first passage means for controlling passage of fluid through said first passage means, flow of fluid through said first passage means and into the cylinder bore of said one piston causing said one piston to move said adjustable member in a direction decreasing the amount of fluid delivered by said pump; second passage means communicating at one end with said first passage means between said control valve and the cylinder bore of said one piston and at the other end with a space at atmospheric pressure; a throttle in said second passage means; and a further passage means connecting the cylinder bore of the other of said pistons with the outlet of the pump.

2. A pressure regulator as defined in claim 3, wherein said control valve comprises a stationary housing formed with a first bore, an elongated valve member closely guided in said first bore of said housing for movement in axial direction, said valve member being formed with a blind bore extending from one end of said valve member into the latter, a small piston closely guided in said blind bore and abutting with one end thereof against a portion of said housing, passage means in said housing and said valve member establishing communication between the pump outlet and said blind bore between the closed end of the latter and the other end of said small piston tending thereby, when fluid is pumped by said pump, to bias the valve member in a first direction in said housing bore, and spring means biasing said valve member in a second direction opposite to said first direction, said valve member being moved in said first and second direction relative to said stationary housing only by the difference between the fluid pressure at said outlet and the pressure of said spring means.

3. A pressure regulator as defined in claim 1, wherein said control valve is a three-way, three-position valve movable between a neutral position preventing flow of fluid from the pump outlet to the cylinder bore of said one pistion, a first working position permitting flow of fluid from said pump outlet to the cylinder bore of said one pistion and flow of fluid through said throttle means into said space, and a second working position permitting unthrottle flow of fluid from said cylinder bore of said one piston to said space.

4. A pressure regulator as defined in claim 2, wherein said passage means in said housing and valve member comprise a single transverse bore through said valve member communicating with said blind bore between the closed end of the latter and the other end of said small piston, and a single passage through said housing communicating with said first bore and said first passage means.

5. A pressure regulator as defined in claim 2, wherein said valve member has three axially spaced annular lands closely guiding said valve member in said first bore of said housing, one of said annular lands being arranged substantially midway between the other two lands and having a predetermined width and cooperating with a second bore through said housing having a diameter at most equal to said predetermined width and communicating at one end with said first housing bore, said first passage having a portion communicating at one end with said second bore through said housing and at the other end with said cylinder bore of said one piston, said one annular land being provided with at least one flat constituting said throttle means for establishing communication between said second bore and said space.

6. A pressure regulator as defined in claim 1, wherein said pump is a radial piston pump having a cylinder block rotatable about a fixed axis and formed with a plurality of radially extending pump cylinder bores and a plurality of pump pistons respectively axially movable in said pump cylinder bores and having outer ends projecting beyond said cylinder block, and wherein said adjustable member comprises an annular member surrounding said cyliner block and having an inner surface against which the outer ends of said pump pistons abut.

* * * * *